US007161593B2

(12) United States Patent
Jones et al.

(10) Patent No.: US 7,161,593 B2
(45) Date of Patent: Jan. 9, 2007

(54) POWER REDUCTION FOR LCD DRIVERS BY BACKPLANE CHARGE SHARING

(75) Inventors: Kevin Jones, Swindon (GB); Julian Tyrrell, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 279 days.

(21) Appl. No.: 10/288,196

(22) Filed: Nov. 5, 2002

(65) Prior Publication Data

US 2004/0080502 A1 Apr. 29, 2004

(30) Foreign Application Priority Data

Oct. 24, 2002 (EP) ..... 02368115

(51) Int. Cl.
*G09G 5/00* (2006.01)

(52) U.S. Cl. ..... 345/211

(58) Field of Classification Search ..... 345/211, 345/212, 213, 102, 100, 204; 349/41–43
See application file for complete search history.

(56) References Cited

U.S. PATENT DOCUMENTS

| | | | | |
|---|---|---|---|---|
| 5,414,443 | A | 5/1995 | Kanatani et al. | 345/95 |
| 5,739,802 | A * | 4/1998 | Mosier | 345/89 |
| 5,852,426 | A * | 12/1998 | Erhart et al. | 345/96 |
| 5,859,625 | A * | 1/1999 | Hartung et al. | 345/95 |
| 5,936,598 | A | 8/1999 | Hayama et al. | 345/76 |
| 5,986,631 | A | 11/1999 | Nanno et al. | 345/94 |
| 6,064,363 | A * | 5/2000 | Kwon | 345/98 |
| 6,124,840 | A | 9/2000 | Kwon | 345/100 |
| 6,573,881 | B1 * | 6/2003 | Kwon | 345/92 |
| 6,593,905 | B1 * | 7/2003 | Lay | 345/92 |
| 6,747,622 | B1 * | 6/2004 | Takahashi et al. | 345/87 |
| 2001/0040569 | A1 | 11/2001 | Liang | |
| 2002/0097209 | A1 * | 7/2002 | Takahashi et al. | 345/87 |

FOREIGN PATENT DOCUMENTS

| | | |
|---|---|---|
| EP | 0558059 A2 | 2/1993 |
| EP | 1058231 A2 | 6/2000 |
| JP | 2001056662 | 2/2001 |

* cited by examiner

*Primary Examiner*—Amr A. Awad
*Assistant Examiner*—Tom Sheng
(74) *Attorney, Agent, or Firm*—Saile Ackerman LLC; Stephen B. Ackerman

(57) ABSTRACT

This invention provides a method and an apparatus for power reduction for LCD drivers using backplane charge sharing. In addition, this invention relates to the use of switches between adjacent backplane drivers in order to transmit and reuse the discharged charge from one backplane's capacitance in order to charge the capacitance of an adjacent backplane. One embodiment of this invention utilizes N metal oxide semiconductor field effect transistors, NMOS-FETs to implement the switch connection between adjacent backplane drivers.

23 Claims, 3 Drawing Sheets

POWER REDUCTION FOR LCD DRIVERS BY BACKPLANE CHARGE SHARING

BACKGROUND OF THE INVENTION

1. Field of the Invention

This invention relates to a method and an apparatus for power reduction for LCD drivers using backplane charge sharing.

More particularly this invention relates to the use of switches between adjacent backplane drivers in order to transmit and reuse the discharged charge from one backplane's capacitance in order to charge the capacitance of an adjacent backplane.

2. Description of Related Art

Currently, liquid crystal display LCD panels are driven with backplane drivers. These drivers are precharged individually every cycle prior to the valid cycle of a given backplane. Similarly, these drivers are discharged individually every cycle after the given backplane is evaluated for display on the LCD panel. The power dissipated each cycle for each backplane and for each driver on the backplanes is substantial and wasteful.

U.S. Pat. No. 6,124,840 (Kwon) "Low Power Gate Driver Circuit for Thin Film Transistor-Liquid Crystal Display (TFT-LCD) Using Electric Charge Recycling Technique" describes a low power gate driver circuit for thin film transistor liquid crystal display using electric charge recycling technique.

U.S. Pat. No. 5,986,631 (Nanno, et al.) "Method for Driving Active Matrix LCD Using only Three Voltage Levels" discloses a method for driving an active matrix liquid crystal display using only three voltage levels.

U.S. Pat. No. 5,414,443 (Kanatani, et al.) "Drive Device for Driving a Matrix-type LCD Apparatus" discloses a drive device for driving a matrix-type liquid crystal display apparatus.

BRIEF SUMMARY OF THE INVENTION

It is the objective of this invention to provide a method and an apparatus for power reduction for LCD drivers using backplane charge sharing.

It is further an object of this invention to use switches between adjacent backplane drivers in order to transmit and reuse the discharged charge from one backplane's capacitance in order to charge the capacitance of an adjacent backplane.

The objects of this invention are achieved by a method of backplane charge sharing for power reduction for LCD, liquid crystal display, liquid crystal display drivers using the steps of connecting a switch between a first backplane, backplane 1, and a second backplane, backplane 2. In addition, the method involves connecting a switch between a second backplane, backplane 2, and a third backplane, backplane 3, and connecting a switch between an nth backplane, backplane n, and an (n+1) backplane, backplane n+1. This method also involves attaching a backplane control signal to each of said backplane switches which connect adjacent backplanes. The method also uses switching between backplane 1 and backplane 2, switching between backplane 2 and backplane 3, and switching between a backplane n and a backplane n+1 where n =3, 4, 5, . . . The switch is closed by a backplane 1 control signal, for a short period of time at the beginning of each backplane period.

The method also involves the closing of the switch between adjacent backplanes. This closed switch allows the discharge of one half of backplane 1's charge from backplane 1's capacitance into the capacitance of backplane 2.

This method results in the sharing of charge between backplane 1 and backplane 2.

A circuit for implementing the switch for the backplane charge sharing for power reduction for LCD, liquid crystal display, drivers is made up of two field effect transistors, FETs, whose drains and sources are connected in common and whose gates are connected to said backplane control signals. The common drains of the FETs are connected to backplane 1 capacitance. The sources of the FETs are connected to backplane 2 capacitances. The gates of the FETs are connected to a switch control signal which when active allows the transfer of charge from the common drains connected to backplane 1 to the common sources connected to backplane 2.

DETAILED DESCRIPTION OF THE INVENTION

Figure 1:
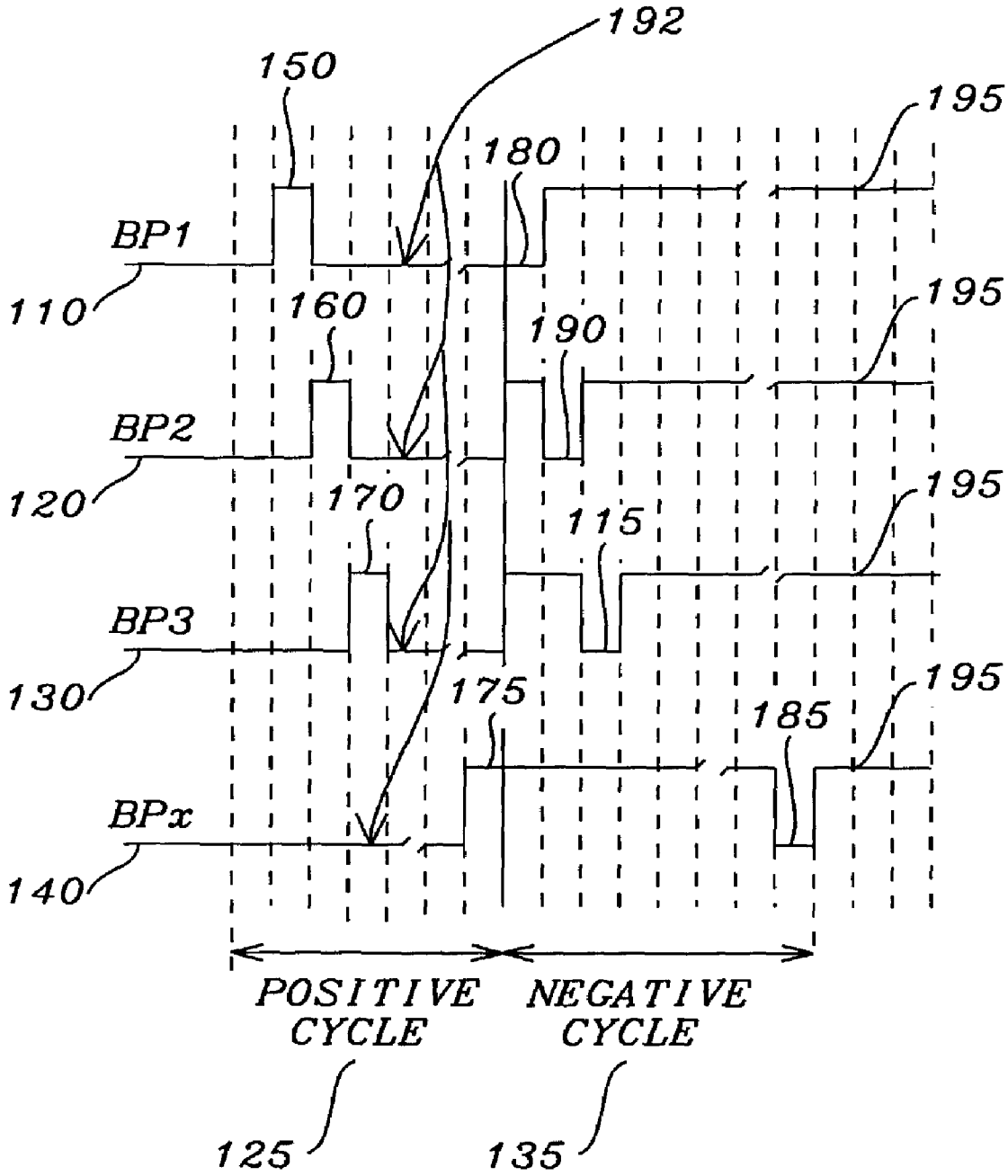
FIG. 1 shows a timing diagram of the backplane drivers for an LCD panel system of this invention.

FIG. 1 shows the backplane driver voltage levels which result form the main embodiment of this invention. Backplane driver 1, BP1 110 has its voltage level 150 shown in FIG. 1. Backplane driver 2, BP2 120 has its voltage level 160 shown in FIG. 1. Backplane driver 3, BP3 130 has its voltage level 170 shown in FIG. 1. The generalized backplane driver n 140 has its voltage level 175 shown in FIG. 1. The timing diagram of FIG. 1 is divided into a positive cycle 125 and a negative cycle 135. The positive cycle 125 occurs when the backplane driver capacitances are being driven high and charged. This FIG. 1 clearly shows that each common backplane driver is fully charged to the same voltage as the preceding common backplane driver. Also, at the end of each backplane period of the positive cycle, the backplane driver is fully discharged 192.

The negative cycle 135 occurs when the backplane driver capacitances are being driven low and discharged. FIG. 1 shows the discharged level of BP1's driver 180. It also shows the discharged level of BP2's driver 190. In addition, FIG. 1 illustrates the discharged level of BP's driver 115. Finally, the general case of the BPx driver's 140 discharge level is shown in FIG. 1–185.

This FIG. 1 also clearly shows that each common backplane driver is fully discharged to the same voltage as the preceding common backplane driver. Also, at the end of each backplane period of the negative cycle 135, the backplane driver is fully charged 195.

Figure 2A:
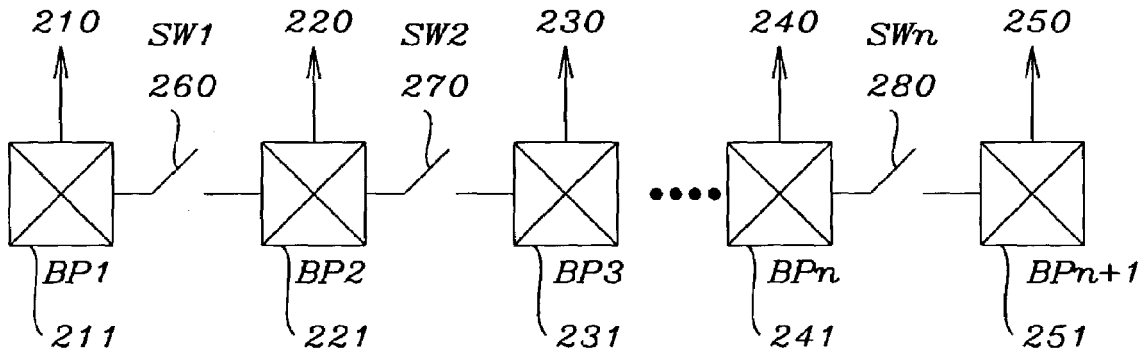
FIG. 2*a* gives a block diagram showing the backplane drivers and switches used to implement the main embodiment of this invention.

FIG. 2*a* shows the backplane drivers 210, 220, 230, 240, 250. The output pads of the backplane drivers are illustrated by 211, 221, 231, 241, 251. These output pads are connections to off-chip connections which include the largely capacitive LCD display panel. The switch between backplane 1-210 and backplane 2-220 is shown as SW1-260. The switch between backplane 2-220 and backplane 3-230 is labeled SW2-270. The switch between backplane n-240 and backplane n+1 250 is shown as SWn 280.

Figure 2B:
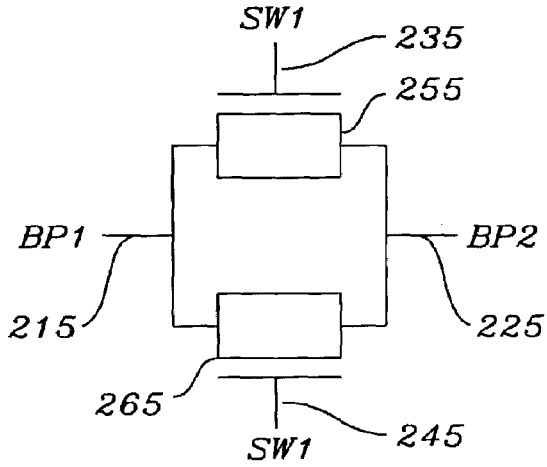
FIG. 2*b* shows two NMOS-FETs used in the apparatus of this invention in order to create switches between adjacent backplane driver capacitances.

FIG. 2*b* shows a field effect transistor, FET implementation of switch SW1 of FIG. 2*a*. As shown in FIG. 2*b*, the drains of NMOS (N-metal oxide semiconductor) FETs 255 and 265 are connected in common. These common drains are tied to Backplane 1, BP1-215. The sources of FETs 255 and 265 are connected in common. These common sources are connected to Backplane 2, BP2-225. The gate 235 of FET 255 and the gate 245 of FET 265 are tied to the SW1 switch control signal.

Figure 3:
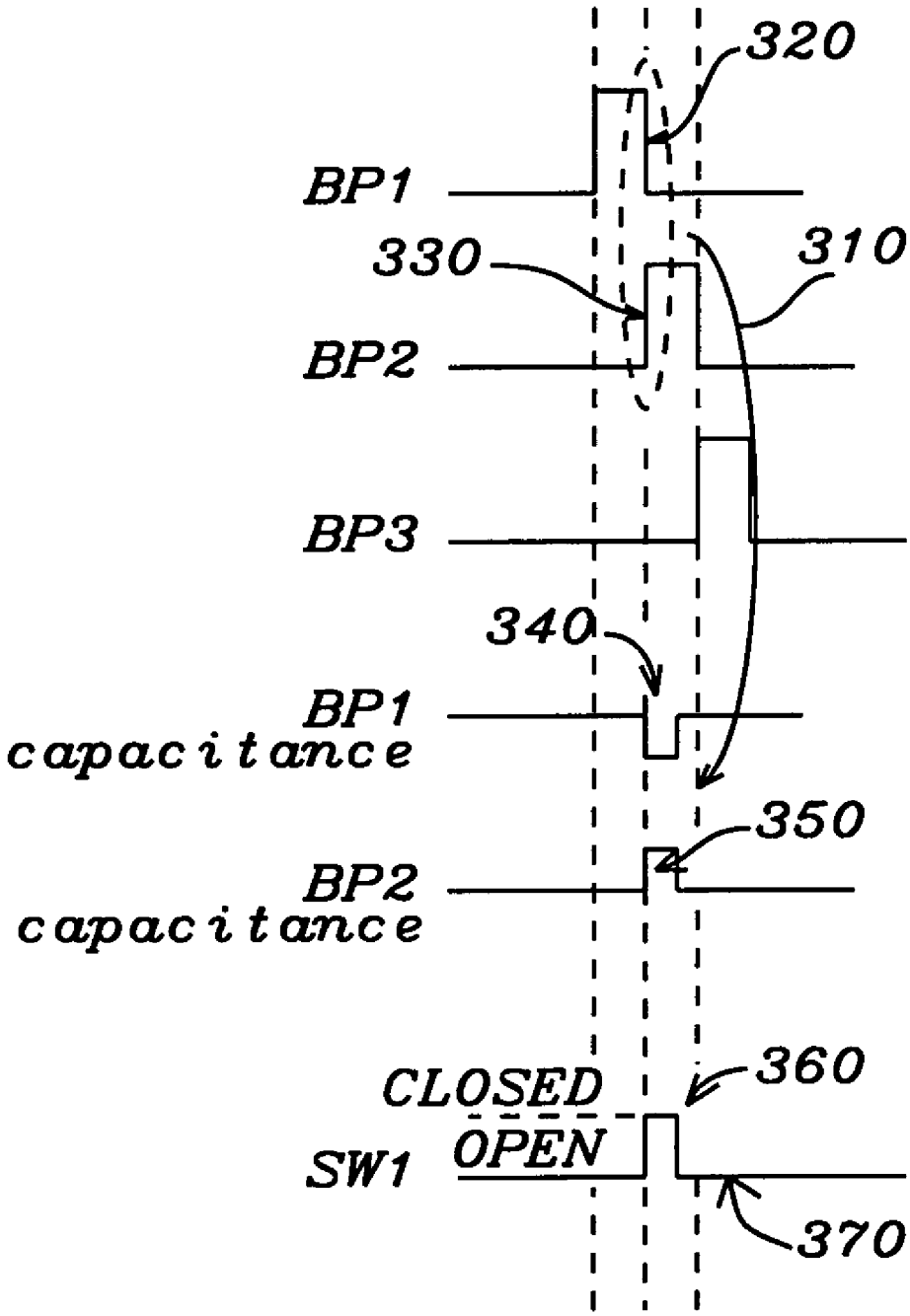
FIG. 3 illustrates the simultaneous discharging and charging of adjacent backplane drivers on a timing diagram.

FIG. 3 shows the transition between Backplane 1"s active time and Backplane 2's active time. The falling edge of Backplane 1's driver 320 corresponds to the rising edge of Backplane 2's driver 330. The backplane 1 capacitance 340 is discharged during this transition 310. The backplane 2's capacitance 350 is charged during this transition. Half of the charge from BP1's capacitance 340 is used to charge BP2's capacitance 350. This is the charge-sharing embodiment of this invention. This charge sharing results in power savings. The switch 1 control signal SW1 is shown being closed 360 and then opened 370 in FIG. 3.

The advantage of this power reduction for LCD drivers by backplane charge sharing method is the saving of one-half of the charging power. This is done by introducing a switch between the backplane drivers. The switch allows the discharging the backplane capacitance for a short period of time. During this short period of time the adjacent backplane is allowed to charge itself using the charge which is simultaneously discharged from the initial backplane capacitance.

While this invention has been particularly shown and described with Reference to the preferred embodiments thereof, it will be understood by those Skilled in the art that various changes in form and details may be made without Departing from the spirit and scope of this invention.

What is claimed is:

1. A method of backplane charge sharing for power reduction for LCD, liquid crystal display, liquid crystal display drivers comprising the steps of:

connecting a first backplane switch between a first backplane and a second backplane, connecting a second backplane switch between the second backplane and a third backplane, connecting an nth backplane switch between an nth backplane and an (n+1)th backplane, attaching a backplane control signal to each of said backplane switches which connect adjacent backplanes, wherein said first backplane switch is closed by a first backplane control signal, for a short period of time at the beginning of each backplane period, wherein a closed first backplane switch discharges one half of said first backplane's charge from said first backplane's capacitance into the capacitance of said second backplane, wherein said discharge of said first backplane and the charge of said second backplane results in the sharing of charge between said first backplane and said second backplane, wherein said first backplane is in a fully-charged state during a positive cycle, and wherein said first backplane is in a fully-discharged state during a negative cycle.

2. The charge sharing method of claim 1 further comprising the steps of:

switching between said first backplane and said second backplane, switching between said second backplane and said third backplane, and switching between said nth backplane and said (n+1)th backplane where n=3, 4, 5, . . . .

3. The method of claim 1 wherein said said second backplane switch is closed by a second backplane control signal, for a short period of time at the beginning of each backplane period.

4. The method of claim 3 wherein said second backplane switch which is closed discharges one half of said second backplane's charge from said second backplane's capacitance into the capacitance of said third backplane.

5. The method of claim 4 wherein said discharge of said second backplane and the charge of said third backplane results in the sharing of charge between said second backplane and said third backplane.

6. The method of claim 1 wherein said nth backplane switch is closed by an nth backplane control signal, for a short period of time at the beginning of each backplane period.

7. The method of claim 6 wherein a closed nth switch discharges one half of said nth backplane's charge from said nth backplane's capacitance into the capacitance of said n+1 backplane.

8. The method of claim 7 wherein said discharge of said nth backplane and the charge of said n+1 backplane results in the sharing of charge between said nth backplane and said n+1 backplane.

9. An apparatus for backplane charge sharing for power reduction for LCD, liquid crystal display, liquid crystal display drivers comprising:

a first backplane switch between a first backplane and a second backplane, a second backplane switch between the second backplane, and a third backplane and an nth backplane switch between an nth backplane and an (n+1)th backplane, a backplane control signal attached to each of said backplane switches which connect adjacent backplanes, wherein said first backplane switch is closed by a first backplane control signal, for a short period of time at the beginning of each backplane period, wherein a closed first backplane switch discharges one half of said first backplane's charge from said first backplane's capacitance into the capacitance of said second backplane, wherein said discharge of said first backplane and the charge of said second backplane results in the sharing of charge between said first backplane and said second backplane, wherein said first backplane is in a fully-charged state during a positive cycle, and wherein said first backplane is in a fully-discharged state during a negative cycle.

10. The charge sharing apparatus of claim 9 further comprising:

means for switching action between said first backplane and said second backplane, means for switching action between said second backplane and said third backplane, and means for switching action between said nth backplane and said (n+1)th backplane where n=3, 4, 5, . . . .

11. The charge sharing apparatus of claim 9 wherein said second backplane switch is closed by said second backplane control signal, for a short period of time at the beginning of each backplane period.

12. The charge sharing apparatus of claim 11 wherein said closed second backplane switch discharges one half of said second backplane's charge from said second backplane's capacitance into the capacitance of said third backplane.

13. The charge sharing apparatus of claim 12 wherein said discharge of said second backplane and the charge of said third backplane results in the sharing of charge between said second backplane and said third backplane.

14. The charge sharing apparatus of 9 wherein said said nth backplane switch is closed by an nth backplane control signal, for a short period of time at the beginning of each backplane period.

15. The charge sharing apparatus of claim 14 wherein said closed nth backplane switch discharges one half of said nth backplane's charge from said nth backplane's capacitance into capacitance of said n+1 backplane.

16. The charge sharing apparatus of claim 15 wherein said discharge of said nth backplane and the charge of said n+1 backplane results in the sharing of charge between said nth backplane and said n+1 backplane.

17. A circuit for implementing a switch for the backplane charge sharing for power reduction for LCD, liquid crystal display, drivers comprising:

two field effect transistors, FETs, whose drains and sources are connected in common and whose gates are connected to backplane control signals wherein a first backplane switch which is comprised of said FETs is closed by a first backplane control signal, for a short period of time at the beginning of each backplane period, wherein a closed first backplane switch discharges one half of said first backplane's charge from said first backplane's capacitance into the capacitance of a second backplane, wherein said discharge of said first backplane and the charge of said second backplane results in the sharing of charge between said first backplane and said second backplane, wherein said first backplane is in a fully-charged state during a positive cycle, and wherein said second backplane is in a fully-discharged state during a negative cycle.

18. The circuit of claim 17 wherein said common drains are connected to a first backplane capacitance and said common sources are connected to a second backplane capacitance.

19. The circuit of claim 17 wherein said gate control signal allows the transfer of charge from the common drains connected to said first backplane to the common sources connected to said second backplane.

20. The circuit of claim 17 wherein said common drains are connected to said second backplane capacitance and said sources are connected to a third backplane capacitance.

21. The circuit of claim 17 wherein said gate control signal allows the transfer of charge from the common drains connected to said second backplane to the common sources connected to said third backplane.

22. The circuit of claim 17 wherein said common drains are connected to said nth backplane capacitance and said sources are connected to an n+1 backplane capacitance.

23. The circuit of claim 17 wherein said gate control signal allows the transfer of charge from the common drains connected to said nth backplane to the common sources connected to said n+1 backplane.

* * * * *